United States Patent [19]

Lohmann

[11] 4,425,834

[45] Jan. 17, 1984

[54] MUNITIONS DISPENSER

[75] Inventor: Arthur M. Lohmann, Hopkins, Minn.

[73] Assignee: Honeywell Inc., Minneapolis, Minn.

[21] Appl. No.: 288,096

[22] Filed: Jul. 29, 1981

[51] Int. Cl.[3] ..... F41F 5/00

[52] U.S. Cl. ..... 89/1 A; 89/6.5

[58] Field of Search ..... 89/1 R, 1 A, 6.5; 102/401; 124/26, 27, 36, 37, 42, 81

[56] References Cited

U.S. PATENT DOCUMENTS

| | | |
|---|---|---|
| 2,919,627 | 1/1960 | Cardona et al. . |
| 3,246,642 | 4/1966 | Cleveland . |
| 3,342,490 | 6/1963 | Payne, Jr. . |
| 3,500,714 | 12/1970 | Cullinane . |
| 3,610,222 | 10/1971 | Hartman . |
| 3,977,386 | 8/1976 | Meyer . |
| 4,080,869 | 3/1978 | Karayannis et al. . |

FOREIGN PATENT DOCUMENTS

| | | | |
|---|---|---|---|
| 2258612 | 8/1975 | France | 89/1 A |
| 1076430 | 7/1967 | United Kingdom | 89/1 A |

*Primary Examiner*—Charles T. Jordan

*Attorney, Agent, or Firm*—George W. Field

[57] ABSTRACT

Apparatus for dispensing mines of short, circularly cylindrical configuration about a spin axis, comprising, in combination, a housing having an opening, an arm mounted in the housing for angular movement about a first pivotal axis between first and second positions, a spring means actuating the arm toward the second position, drive mechanism operable to move the arm to, and releaseably hold the arm in, the first position, a cylindrical friction member arcuate about the first pivotal access from a site adjacent to the opening, and a holder mounted on the arm to receive a mine with its spin axis parallel to the pivotal axis and with its cylindrical surface in engagement with the friction member, so that when the arm is moved into the first position and released, a mine in the holder is propelled along said friction member and is ejected through the opening, while rotating about the spin access.

9 Claims, 8 Drawing Figures

MUNITIONS DISPENSER

TECHNICAL FIELD

This invention relates to the field of logistics, and specifically to a procedure and apparatus for dispensing mines.

BACKGROUND OF THE INVENTION

In military operations it is sometimes necessary to render an area impassable by use of land mines which explode to destroy vehicles attempting to pass. A system is known by which mines are dispensed automatically from a supply carried by a vehicle, the mines being projected to fall on the ground at a distance from the vehicle, and having pre-arming, arming, and self-destruct circuitry. The mines are of short, circularly cylindrical configuration, and for proper operation must be dispensed with a spin about the axis of the cylinder. They are referred to as GEMSS mines and the dispenser is given the identification XM128: details of this equipment are not necessary to an understanding of the present invention, which comprises a back-up for the XM128 to enable dispensing of the mines to continue, if somewhat less rapidly, should the XM128 become disabled.

BRIEF SUMMARY OF THE INVENTION

The invention comprises apparatus for the dispensing of mines one at a time by a human operator with safety to the operator and without any modification of the mines, which are projected with the necessary spin and linear velocity and given a necessary magnetic signal: entirely manual operation is possible, but motor means is provided for use when a power source is available, to increase the speed of operation.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals indicate corresponding parts throughout the several views.

DESCRIPTION OF THE PREFERRED EMBODIMENT

Figure 1:
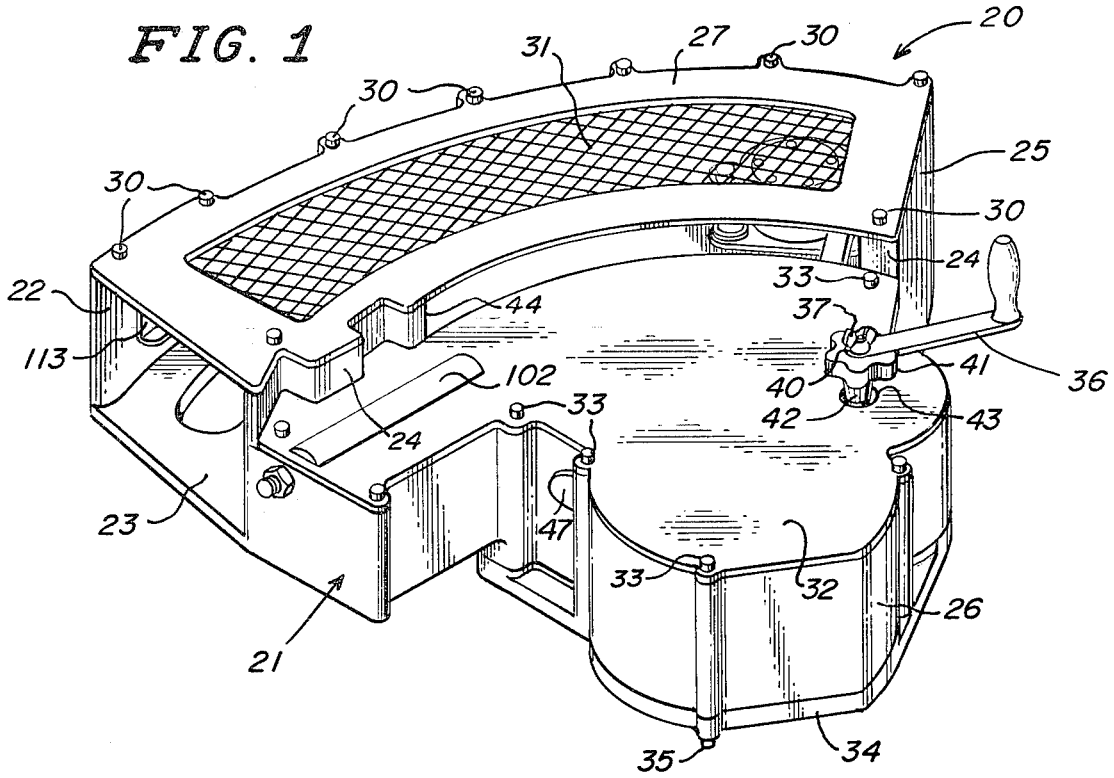
FIG. 1 is a view in perspective of a dispenser according to the invention.
Figure 2:
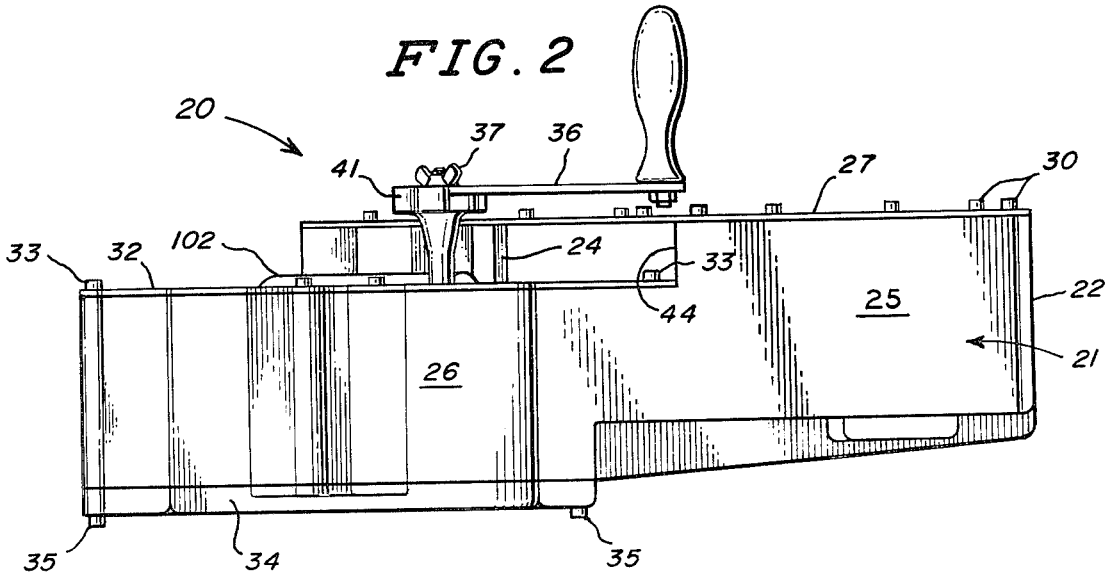
FIG. 2 is a side view of the dispenser seen from the right of FIG. 1.

Turning first to FIGS. 1 and 2, a dispenser 20 according to the invention is shown to comprise a housing 21 having the general configuration of a cylindrical sector, with an arcuate outer wall 22 and a dispensing opening 23. The housing is divided by arcuate partition 24 into a dispensing chamber 25 and a power chamber 26. A cover 27 is secured to chamber 25 by fasteners 30, and includes a grillwork 31 through which the chamber may be observed. Chamber 26 is of less height than chamber 25, and has a top cover 32 secured by fasteners 33, and a bottom cover 34 secured by fasteners 35. A hand crank 36 is secured by a wing nut 37 in a groove 40 of a knob 41 carried on a shaft 42 which projects upwardly through an aperture 43 in a cover 32. A central portion 44 of partition 24 is cut away for a reason presently to be explained.

Figure 3:
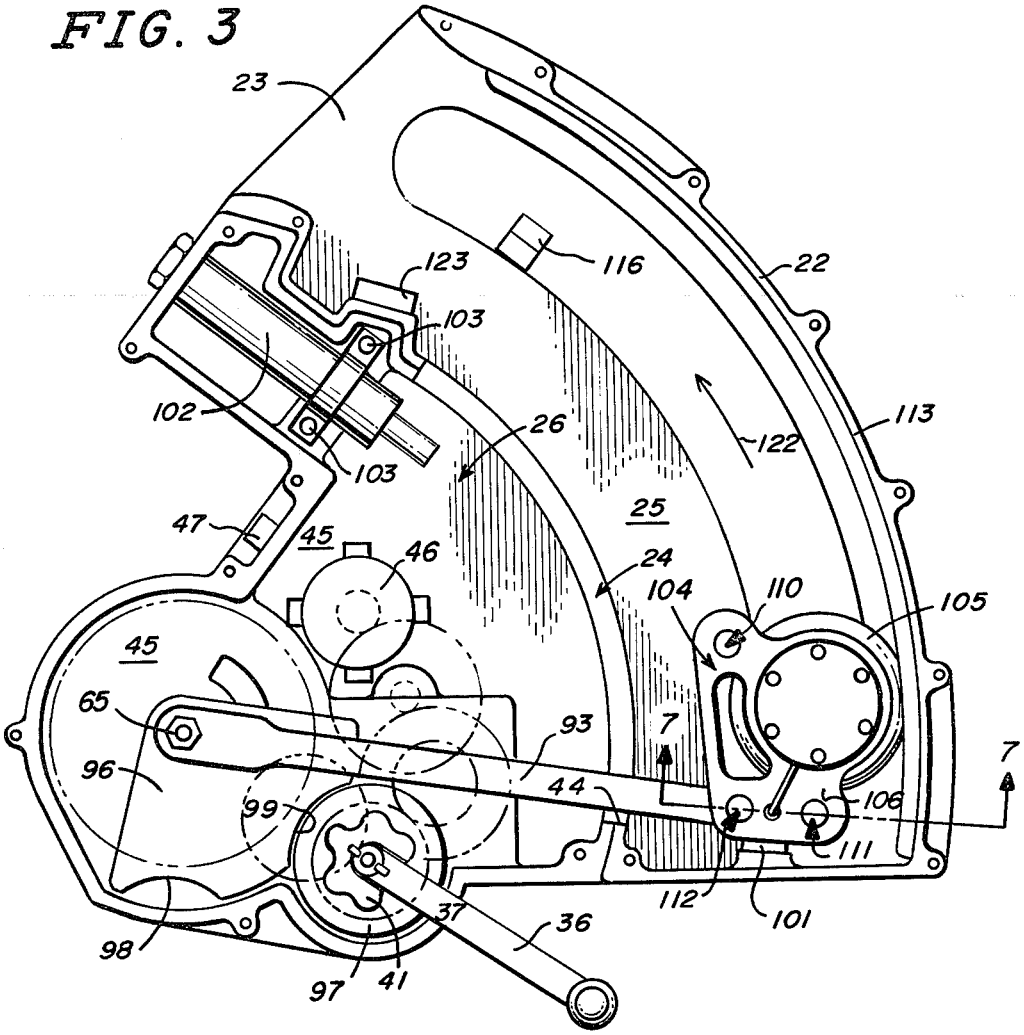
FIG. 3 is a plan view of the dispenser with certain covers removed.
Figure 4:
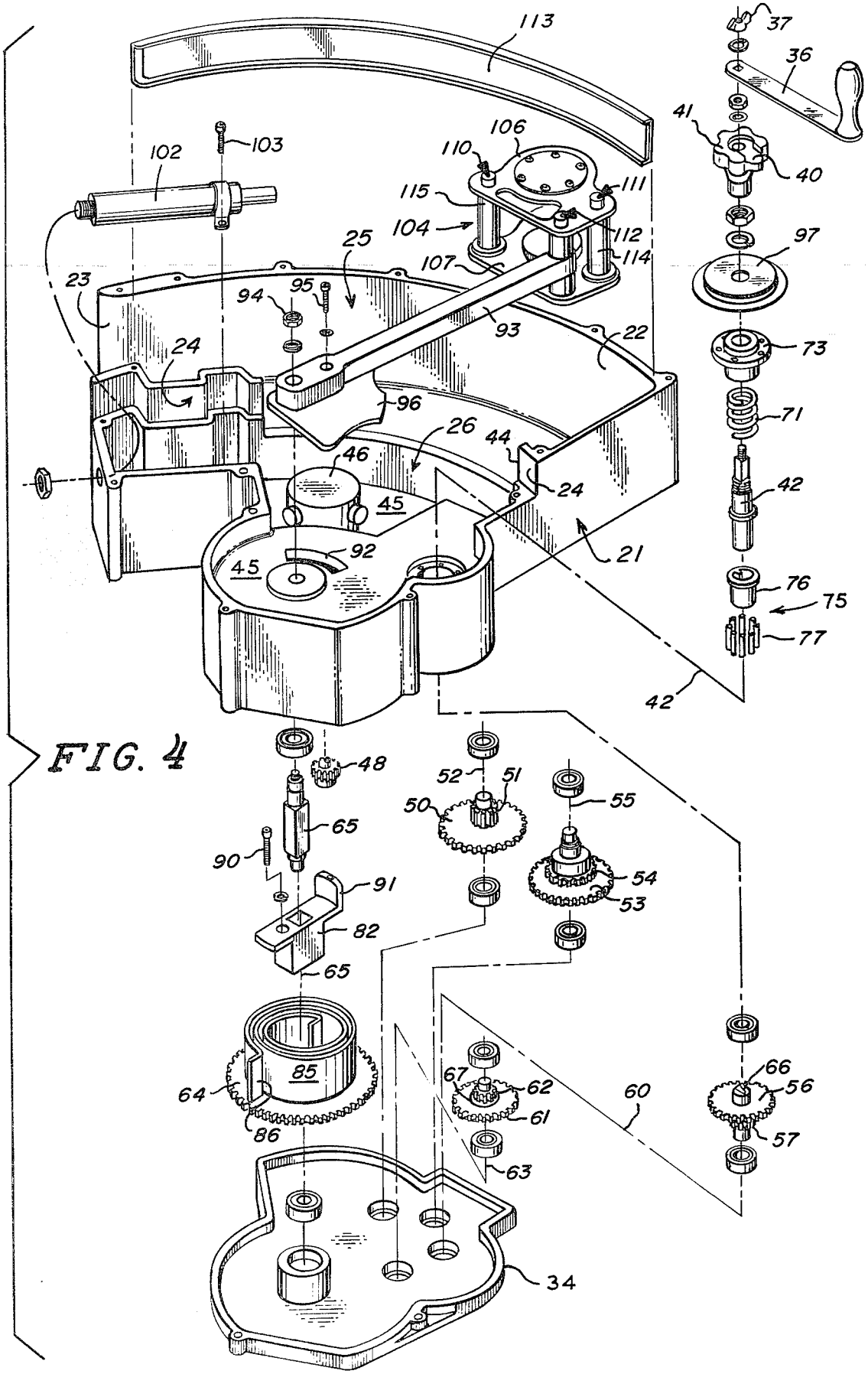
FIG. 4 is an exploded view of the dispenser.

As shown in FIGS. 3 and 4, chamber 25 has a stepped, generally horizontal partition 45 to support an electric motor 46 and the upper bearings of a plurality of shafts presently to be described, for which bottom cover 34 supports the lower bearings. Energy is supplied to motor 46 through a connector 47.

Figure 5:
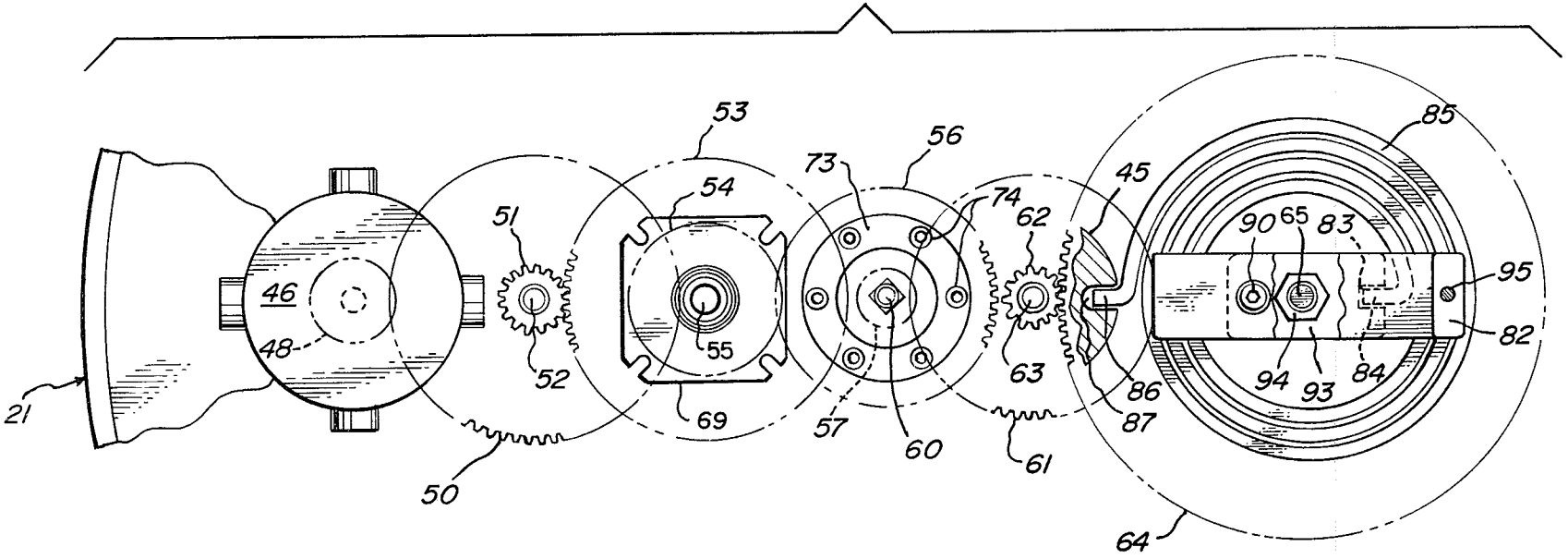
FIGS. 5, 6, and 7 are developed views of a gear train used in the invention.
Figure 6:
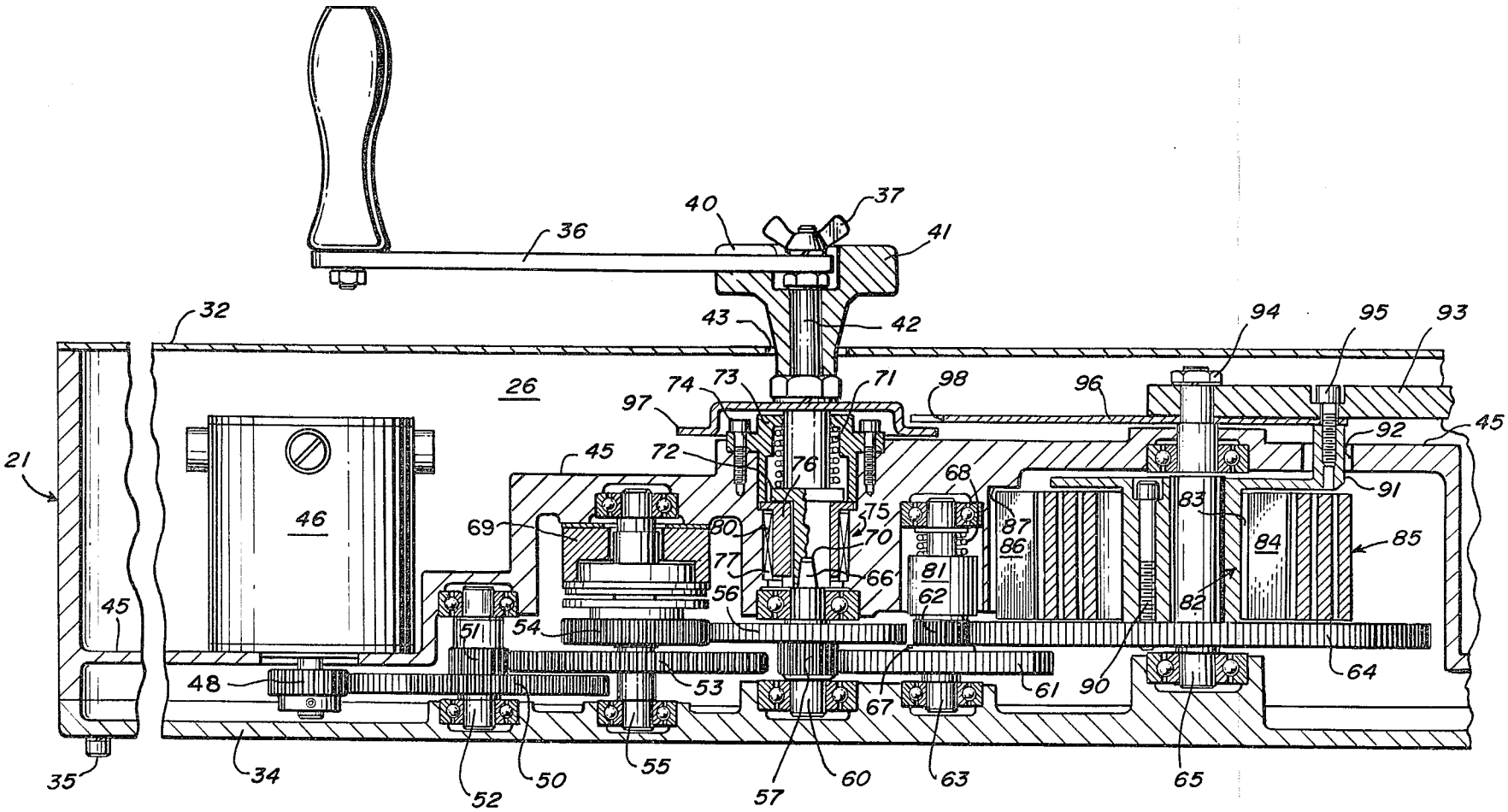
Figure 7:
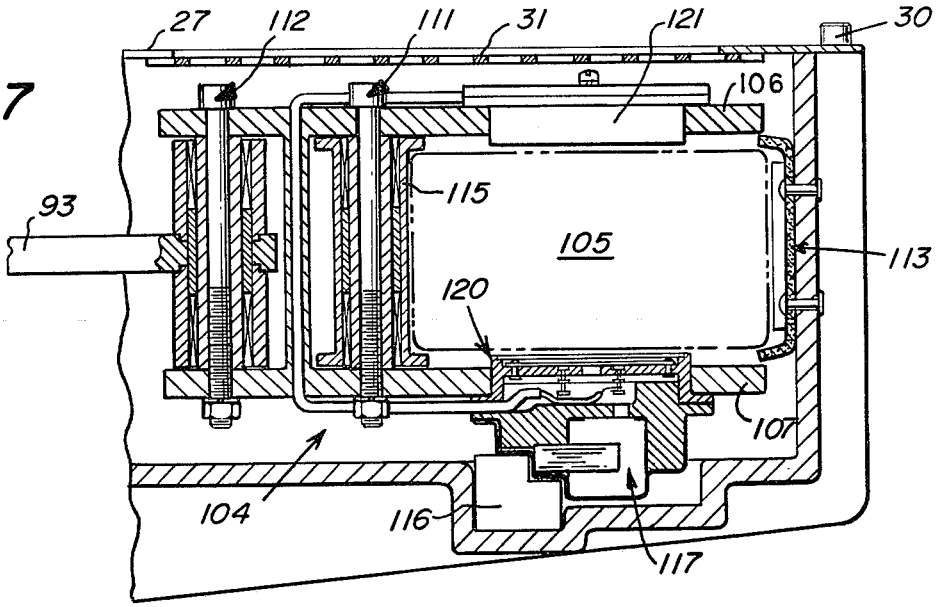

As shown in somewhat developed form in FIGS. 5, 6, and 7, a power train may be traced from a pinion 48 on the shaft of motor 46 through a gear 50 and a pinion 51 on a shaft 52, a gear 53 and a pinion 54 on a shaft 55, a gear 56 and a pinion 57 on a shaft 60, a gear 61 and a pinion 62 on a shaft 63, to a gear 64 on a shaft 65. Pinion 62 is part of a sprag 81 mounted on shaft 63, and is pressed against a friction disc 67 by a compression spring 68. Rotation of shaft 63 by gear 61 in one direction results in drive of pinion 62, but the pinion is free to overrun on the shaft in the other direction until stopped by friction of disc 67 with gear 61 and pinion 62. A magnetic clutch 69 is provided on shaft 55 to enable or disable the drive connection between gear 53 and pinion 54.

The upper end of shaft 60 has a diametral tongue 66 extending axially into a matching diametral groove 70 in the lower end of shaft 42. Shaft 42 is coaxial with and is mounted for a limited axial movement with respect to shaft 60, being urged towards shaft 60 by a compression spring 71 acting between a shoulder 72 on shaft 42 and a cover plate 73 mounted on partition 45 by fasteners 74.

A sprag or roller clutch 75 has an inner member 76 keyed to shaft 42, and a plurality of rollers in a housing 77 received in a bore 80 in partition 45. This arrangement permits rotation of shaft 42 in a first direction, whether driven by crank 36 or by motor 46, but locks shaft 42 against rotation in the opposite direction, the lock being releasable when shaft 42 is displaced axially to disengage tongue 66 from groove 70.

Shaft 65 has a central squared portion to receive a drive member 82 slotted at 83 to receive one end tab 84 of a stiff spiral spring 85. The other end tab 86 of spring 85 is received in a slot 87 in partition 45. Drive member 82 is secured to gear 64 by a fastener 90, and has a finger 91 which projects through an arcuate groove 92 in partition 45. Above the partition an arm 93 is mounted on shaft 65 and finger 91 by fasteners 94 and 95 respectively, to pivot about the axis of shaft 65. As shown in FIGS. 3 and 6 a stop plate 96 is mounted for rotation with shaft 65, and overlies a disc 97 carried on shaft 42 under knob 41 except in two positions of the stop plate, where arcuate cutouts 98 and 99 are provided.

Arm 93 extends through the central portion 44 of partition 24 into dispensing chamber 25 for arcuate movement between a first or ready position, in which it engages a stop 101 carried by housing 21, and a second or loading position in which it engages a shock absorber 102 mounted in housing 21 by fasteners 103. Spring 85 acts to urge arm 93 toward its loading position, and sprag 75 is oriented to normally prevent this movement, enabling motor 46 or handcrank 36 to drive the arm to the loaded position and retaining it there until intentionally released.

At its outer end arm 93 pivotally supports a holder 104 to receive a mine for dispensing, indicated at 105 in FIGS. 3 and 7. Holder 104 includes upper and lower plates 106 and 107 held separated by spacing fasteners 110, 111 and 112. Fastener 112 pivotally mounts the holder on arm 93 for movement about an axis parallel to the axis of shaft 65 and to the spin axis of the mine.

A fence or track 113 of friction material such as polyethylene neoprene rubber is secured to the inner surface of arcuate wall 22. When a mine is inserted into holder 104 its circumference engages track 113 and a pair of rollers 114 and 115 carried on fasteners 111 and 110.

A permanent magnet 116 is mounted in housing 21 (FIG. 3) for actuating a magnetic pick-up 117 carried by holder 104 (FIG. 7). This results in application of signals to the arming circuitry of the mine through inserts 120 and 121 in plates 106 and 107: two such inserts are provided so that the mine can be inserted into holder 104 in either orientation. The circuitry was worked out for use with previous, more elaborate dispensing devices, and is used here without change.

Specially to be noted with regard to holder 104, which may illustratively be considered a "hand" carried by "arm" 93, is that the center of gravity of the holder is radially outward of the pivotal axis in fastener 112. Thus acceleration of the arm in the direction of arrow 122 in FIG. 3 acts to press mine 105 more firmly against track 113 by rollers 114 and 115. A stop member 123 is provided to receive holder 104 in the loading position of the arm.

Figure 8:
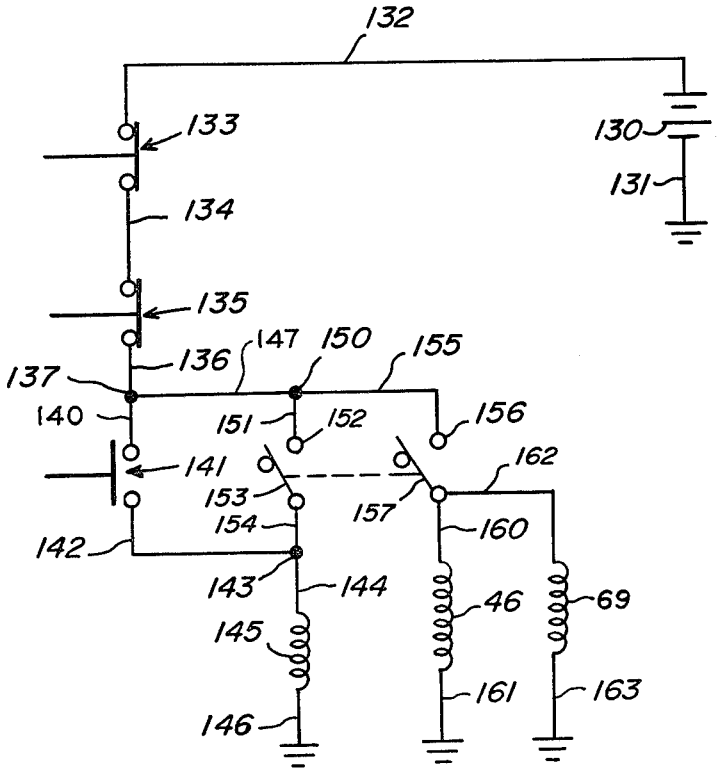
FIG. 8 is a wiring diagram.

FIG. 8 shows one possible motor control circuit for use with this dispenser. One terminal of a power source 130 is grounded at 131. A circuit may be traced from the other terminal of the source through conductor 132, a normally closed autodisengage switch 133, conductor 134, a normally closed handle interlock switch 135, conductor 136, a junction point 137, conductor 140, a normally open engage switch 141, conductor 142, a junction point 143, conductor 144, and a relay winding 145 to a ground connection 146. From junction point 137 the circuit may be traced through conductor 147, junction point 150, conductor 151, normally open relay contacts 152 and 153, and conductor 154 to junction point 143, and from junction point 150 through conductor 155, normally open relay contacts 156 and 157, and thence by conductor 160 to motor 46 and ground connection 161, and by conductor 162 to clutch 69 and ground connection 163.

Switch 141 is mounted in housing 21 where convenient for manual operation. Switch 133 is mounted near stop 101, to be opened when arm 93 reaches its full loaded position. Switch 135, if used, is mounted in knob 41, to be held open when crank 36 is secured in knob 41 by wing nut 37.

OPERATION

The dispenser is intended for use as an alternative to more elaborate dispensing equipment in suitable limited applications. It ejects the mine at a velocity of 50 feet per second, spinning the mine at 2,500 revolutions per minute, and giving it the necessary control signal magnetically.

In use, arm 93 is initially in the loading position, in engagement with the shock absorber 102, and holder 104 is in engagement with stop member 123. A mine is inserted into holder 104, and hand crank 36 is operated to drive shaft 42, groove 70, tongue 66, pinion 57, gear 61, pinion 62, and gear 64 to produce tension in spring 85, and to move arm 93 from a position near opening 23 until it meets stop 101 and is in its ready position. Sprags 75 and 81 enable this movement, and sprag 75 prevents movement in the reverse direction. Gear 56 drives pinion 54, but clutch 69 is disengaged and gear 53 is disengaged.

Cutout 99 is now aligned with disk 97. When it is desired to dispense the mine, knob 41 is pulled axially, disengaging groove 70 from tongue 67. Spring 85 now drives arm 93 in the direction of arrow 122 from its loaded position to its loading position: the initial acceleration causes rollers 114, 115 to force the mine against the track 113, so that the mine rolls along the track and acquires a spin about its axis. As the mine reaches opening 23 arm 93 engages shock absorber 102 and holder 104 engages stop means 123, but the inertia of the mine carries it past magnet 116, which gives it the necessary signal, and out of dispensing opening 23, still spinning about its axis at the rate necessary for proper operation. No rotation of crank 36 takes place, and clutch 69 disconnects gear 53, pinion 51, gear 50, pinion 48, and motor 46 from the rest of the train. Note that the direction of force transmittal in spray 81 is the same, whether the spring is being wound up or is unwinding. However, when the arm is arrested at shock absorber 102, sprag 81 allows the gears back to pinion 54 to overrun until stopped by friction of disc 67, thus eliminating any shock on the gear train.

During the movement of arm 93 plate 96 moves under disc 97, so that shafts 62 and 60 cannot inadvertently become engaged which prevents the disengagement of the hand crank before the loading operation is completed.

While dispensing of single mines by use of crank 36 is possible, the effectiveness of the dispenser can be enhanced when external power is available. The dispenser may be connected to a suitable power source, the battery of a vehicle for example, at connector 47, and motor 46 may be energized by closure of switch 141 to propel arm 93 loaded with a mine into its loaded position: clutch 69 is simultaneously energized to complete the drive train to the motor. When loading is complete, the motor and clutch are deenergized, sprag 75 retaining the arm in position, and when knob 41 is displaced axially the spring causes the mine to be dispensed as before.

When motor operation is intended crank 36 may be removed for operator safety, allowing switch 135 to close. A mine 105 is inserted in holder 104 and switch 141 is momentarily closed, energizing relay 145 to close holding contacts 152–153 and also contacts 156–157, this in turn energizing motor 46 to operate and clutch 69 to transmit power through the gear train. When arm 93 reaches its loading position, switch 133 opens, deenergizing relay 145 which deenergizes motor 46 and clutch 69. Sprag 75 however locks the arm in position until knob 41 is moved axially, when the mine is dispensed as before. Switch 133 again closes, and the cycle can be repeated.

From the foregoing it will be evident that the invention comprises a device for dispensing mines individually by hand or electric power, the mines being given the proper magnetic signal and being spun at the proper speed to give satisfactory operation. The dispenser has features increasing safety of the operator, and minimizing the effect of mechanical shock on the gear train, and includes an arm-and-holder in pivotal relation so that the acceleration of the mine increases its driving contact with a friction track for producing the desired spin.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the inveniton, to the full extent indicated by the broad general meaning of the terms in which the appended claims are expressed.

I claim:

1. Apparatus for dispensing mines of short, circularly cylindrical configuration about a spin axis, comprising, in combination:

a housing having an opening;

an arm mounted in said housing for angular movement about a first pivotal axis between first and second positions;

resilient means actuating said arm toward said second position;

drive means operable to move said arm to, and releaseably hold said arm in, said first position;

a cylindrical friction member arcuate about said first pivotal axis from a site adjacent to said opening; and a holder mounted on said arm to receive a mine with its spin axis parallel to said pivotal axis and with its cylindrical surface in engagement with said friction member, so that when said arm is moved into said first position and released, a mine in said holder is propelled along said friction member and is ejected through said opening, while rotating about said spin axis.

2. Apparatus according to claim 1 in which said holder is mounted for movement with respect to said arm about a second pivotal axis parallel to said first pivotal axis and located radially inwardly from the center of gravity of said holder, so that acceleration of said arm imparts a radially outwardly component of motion to said holder.

3. Apparatus according to claim 2 in which said holder includes roller means for contacting the cylindrical surface of a mine to actuate the mine against the friction member.

4. Apparatus according to claim 1 in which the drive means includes manual means rotatable about and moveable along an axis, means transmitting rotation of said manual means in a first direction to said arm and releaseable means preventing rotation of said manual means in the opposite direction.

5. Apparatus according to claim 4 including means for releasing said releasable means in response to axial movement of said manual means, to enable said resilient means to drive said arm to said second position.

6. Apparatus according to claim 4 in which said transmitting means includes means preventing the shock of sudden arrest of said arm and resilient means from being transmitted to the rotation transmitting means.

7. Apparatus according to claim 4 in which said drive means includes an electric motor and means connecting said motor in driving relation to the rotation transmitting means.

8. Apparatus according to claim 1 in which said drive means includes motor means, means transmitting rotation of said motor means in a first direction to said arm, and releasable means preventing rotation of the transmitting means in the opposite direction.

9. Apparatus according to claim 2 further including means arresting motion of said arm about said first pivotal axis in said second position, and means arresting resultant movement of said holder about said second pivotal axis.

* * * * *